US008634749B2

(12) United States Patent
Aratachi et al.

(10) Patent No.: US 8,634,749 B2
(45) Date of Patent: Jan. 21, 2014

(54) IMAGE FORMING APPARATUS

(75) Inventors: Tomitake Aratachi, Aichi (JP); Yoshiteru Hattori, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 128 days.

(21) Appl. No.: 13/362,034

(22) Filed: Jan. 31, 2012

(65) Prior Publication Data

US 2012/0243910 A1 Sep. 27, 2012

(30) Foreign Application Priority Data

Mar. 23, 2011 (JP) ..... 2011-064357

(51) Int. Cl.
*G03G 15/00* (2006.01)

(52) U.S. Cl.
USPC ..... 399/236

(58) Field of Classification Search
USPC ..... 399/236, 53
See application file for complete search history.

(56) References Cited

U.S. PATENT DOCUMENTS

| | | | | |
|---|---|---|---|---|
| 5,043,771 | A * | 8/1991 | Shibata et al. | 399/396 |
| 2006/0188291 | A1 | 8/2006 | Kawakami et al. | |
| 2009/0324305 | A1* | 12/2009 | Udaka et al. | 399/302 |
| 2012/0243908 | A1* | 9/2012 | Aratachi et al. | 399/167 |
| 2012/0243910 | A1 | 9/2012 | Aratachi et al. | |

FOREIGN PATENT DOCUMENTS

| | | | |
|---|---|---|---|
| JP | H03-155577 | A | 7/1991 |
| JP | H04-060650 | A | 2/1992 |
| JP | 05-265271 | | 10/1993 |
| JP | 06-035312 | | 2/1994 |
| JP | H06-250559 | A | 9/1994 |
| JP | H09-258548 | A | 10/1997 |
| JP | H10-142944 | A | 5/1998 |
| JP | 2001-042635 | | 2/2001 |
| JP | 2005-309042 | A | 11/2005 |
| JP | 2006-184555 | | 7/2006 |
| JP | 2008-033215 | | 2/2008 |

OTHER PUBLICATIONS

Office Action issued in corresponding Japanese Patent Application No. 2011-064358 mailed Jul. 9, 2013.
Office Action issued in corresponding Japanese Patent Application No. 2011-064357, mailed Jul. 30, 2013.
Notice of Allowance received in corresponding U.S. Appl. No. 13/362,007 mailed Oct. 9, 2013.

* cited by examiner

*Primary Examiner* — G. M. Hyder
(74) *Attorney, Agent, or Firm* — Banner & Witcoff, Ltd.

(57) ABSTRACT

An image forming apparatus is provided, which includes a controller configured to determine a moment for switching a circumferential velocity of a development roller to a first circumferential velocity from a second circumferential velocity lower than the first circumferential velocity based on a moment when the controller issues to a sheet feeding unit an instruction to start feeding of a sheet, and to determine a moment for switching the circumferential velocity of the development roller to the second circumferential velocity from the first circumferential velocity based on a moment when a first detector detects existence of the sheet ejected from a registration roller.

8 Claims, 10 Drawing Sheets

OFF

ON

IMAGE FORMING APPARATUS

CROSS-REFERENCE TO RELATED APPLICATION

This application claims priority under 35 U.S.C. §119 from Japanese Patent Application No. 2011-064357 filed on Mar. 23, 2011. The entire subject matter of the application is incorporated herein by reference.

BACKGROUND

1. Technical Field

The following description relates to one or more image forming apparatuses configured to transfer development agent onto a sheet to electrophotographically form an image on the sheet.

2. Related Art

A technique has been known that causes a development roller to rotate at a slow rotational speed so as to prevent development agent from being deteriorated.

SUMMARY

The known technique is, for example, intended to form a desirable image on a sheet even when one page of image data contains a halftone image and a solid image. It is noted that the term "a solid image" denotes an image filled with such a dark color as to render visually unrecognizable a background color of the sheet behind the dark color of the image.

More specifically, the known technique is adapted to change the rotational speed of the development roller based on an exposure ratio of an exposure area to a non-exposure area on a photoconductive drum when developing a developer image to be transferred onto the sheet on the photoconductive drum. Thereby, it is possible to prevent the development agent from being deteriorated.

Therefore, for instance, when the image data contains only a solid image, the known technique might not prevent deterioration of the development agent.

Aspects of the present invention are advantageous to provide one or more improved image forming apparatuses that achieve an improved effect for preventing deterioration of development agent.

According to aspects of the present invention, an image forming apparatus is provided that is configured to transfer development agent onto a sheet to electrophotographically form an image on the sheet, the image forming apparatus including a photoconductive drum configured to carry the development agent to be transferred onto the sheet, an exposure unit configured to expose the photoconductive drum, a development roller configured to supply the development agent to the photoconductive drum exposed by the exposure unit and develop the photoconductive drum, a feed tray configured to accommodate the sheet to be fed to the photoconductive drum, a sheet feeding unit configured to feed the sheet placed on the feed tray to the photoconductive drum, a registration roller disposed on a feeding pathway from the feed tray to the photoconductive drum, the registration roller being configured to once stop the feeding of the sheet by the sheet feeding unit and adjust timing for transferring the development agent onto the sheet, a first detector disposed downstream relative to the registration roller in a feeding direction, the first detector being configured to detect existence of the sheet ejected from the registration roller, a circumferential velocity switching mechanism configured to switch a circumferential velocity of the development roller between a first circumferential velocity and a second circumferential velocity lower than the first circumferential velocity, and a controller configured to determine a moment for switching the circumferential velocity of the development roller from the second circumferential velocity to the first circumferential velocity based on a moment when the controller issues to the sheet feeding unit an instruction to start feeding of the sheet, and to determine a moment for switching the circumferential velocity of the development roller from the first circumferential velocity to the second circumferential velocity based on a moment when the first detector detects the existence of the sheet ejected from the registration roller.

BRIEF DESCRIPTION OF THE ACCOMPANYING DRAWINGS

Figure 3A:
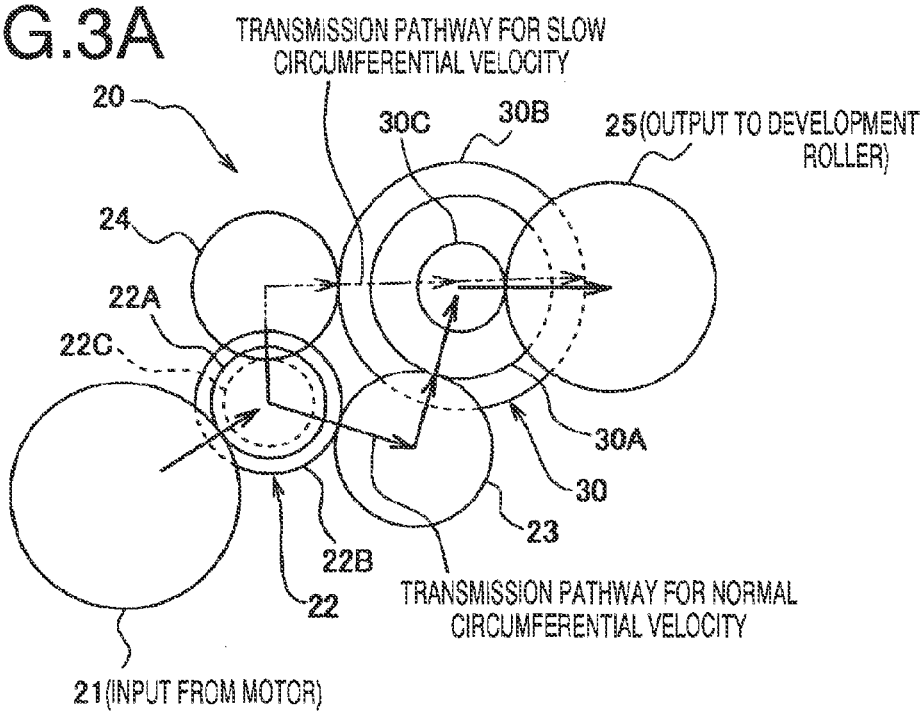

FIG. 3A schematically shows a configuration of a gear mechanism of the image forming apparatus in the first embodiment according to one or more aspects of the present invention.

Figure 3B:
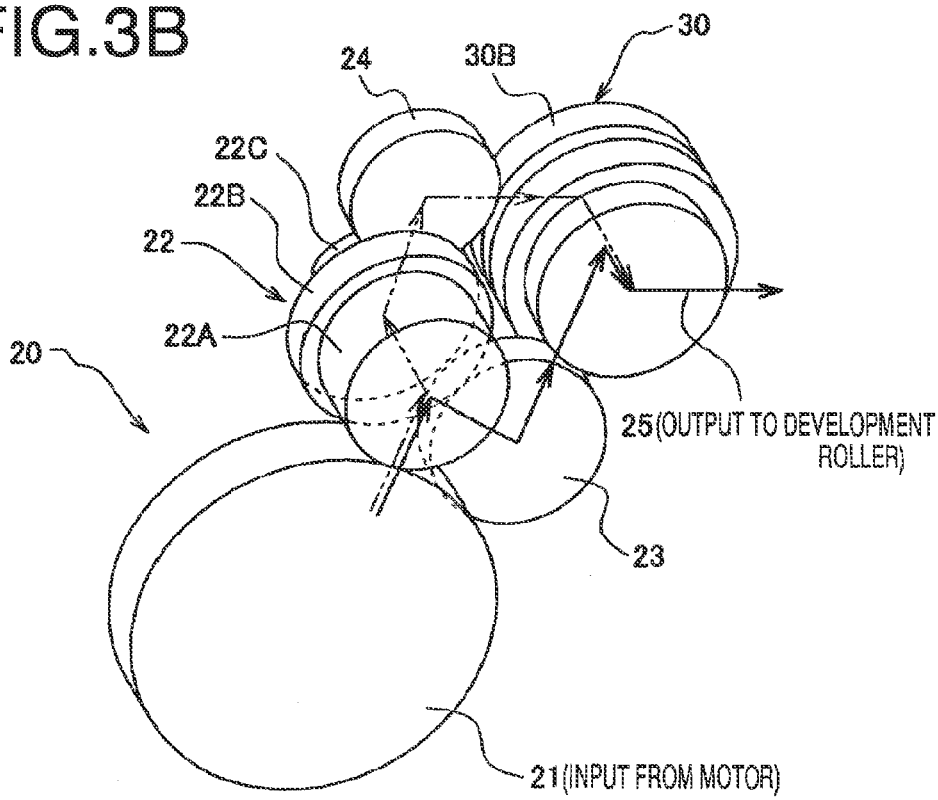

FIG. 3B is a perspective view showing the configuration of the gear mechanism of the image forming apparatus in the first embodiment according to one or more aspects of the present invention.

Figure 4B:
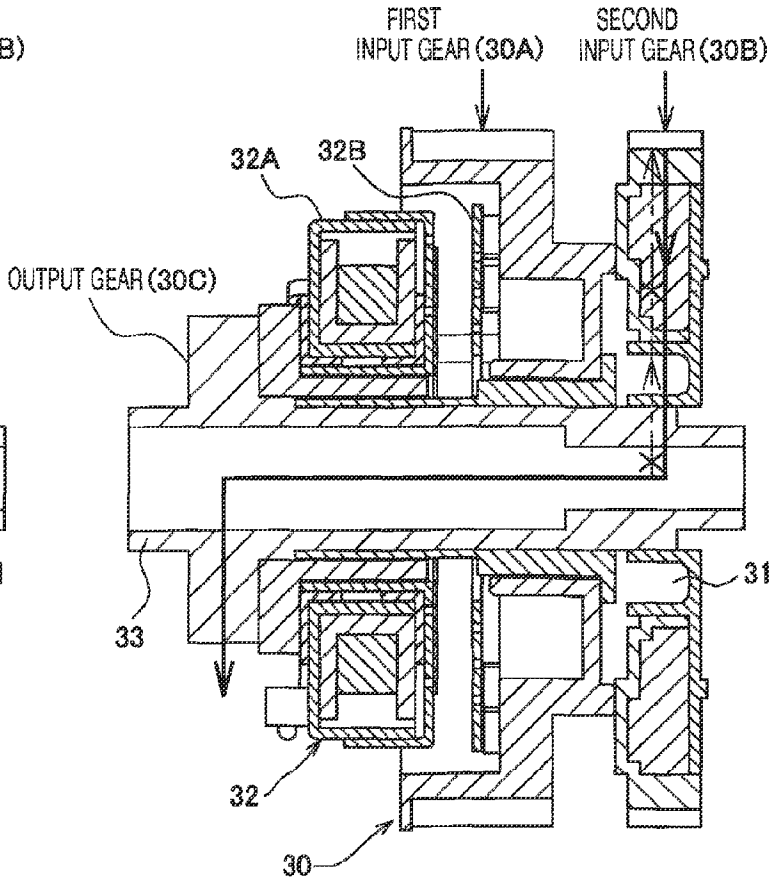
Figure 4A:
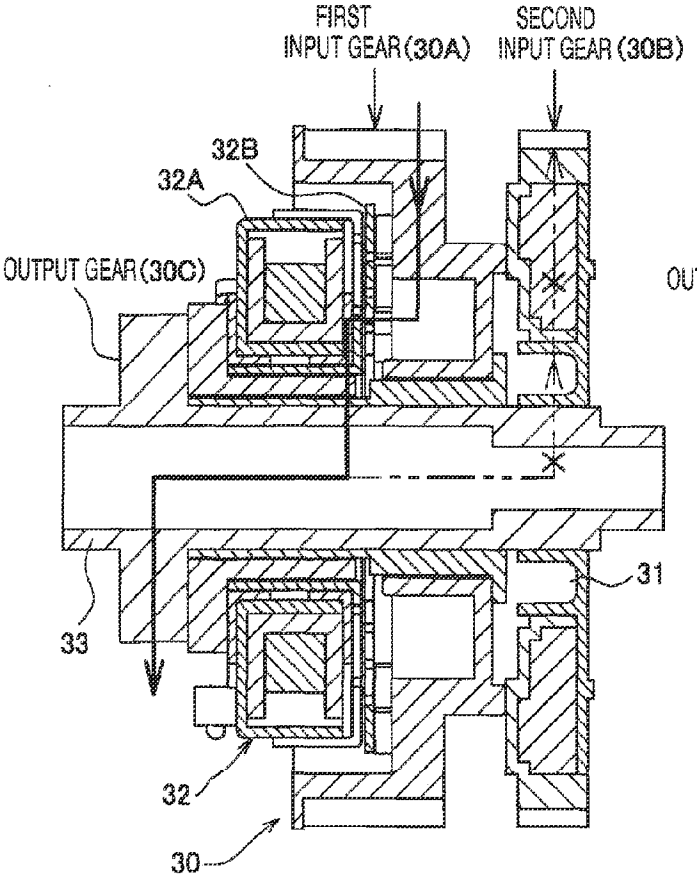

FIGS. 4A and 4B are cross-sectional views of a development roller electromagnetic clutch in the first embodiment according to one or more aspects of the present invention.

Figure 5A:
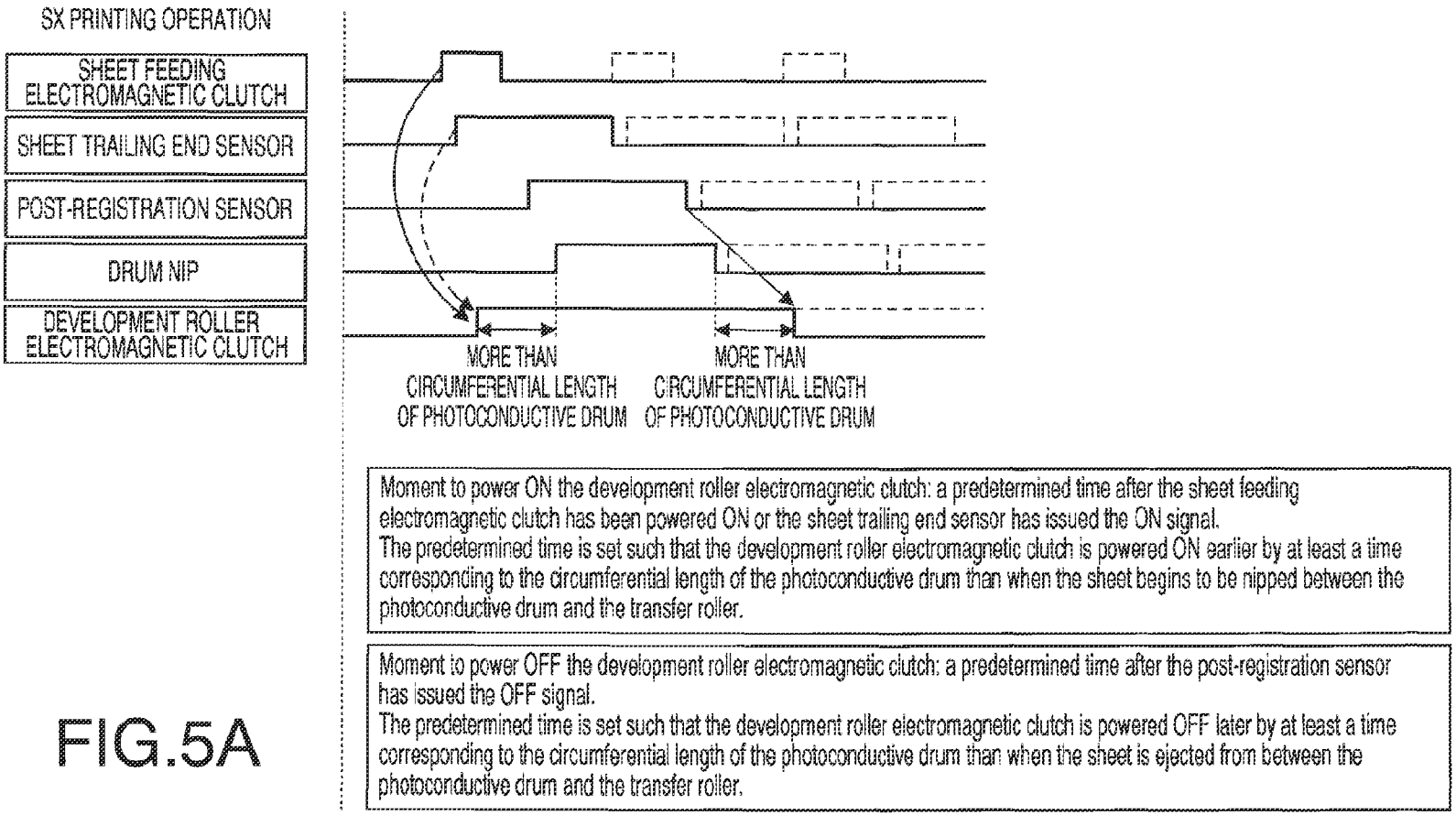
Figure 5B:
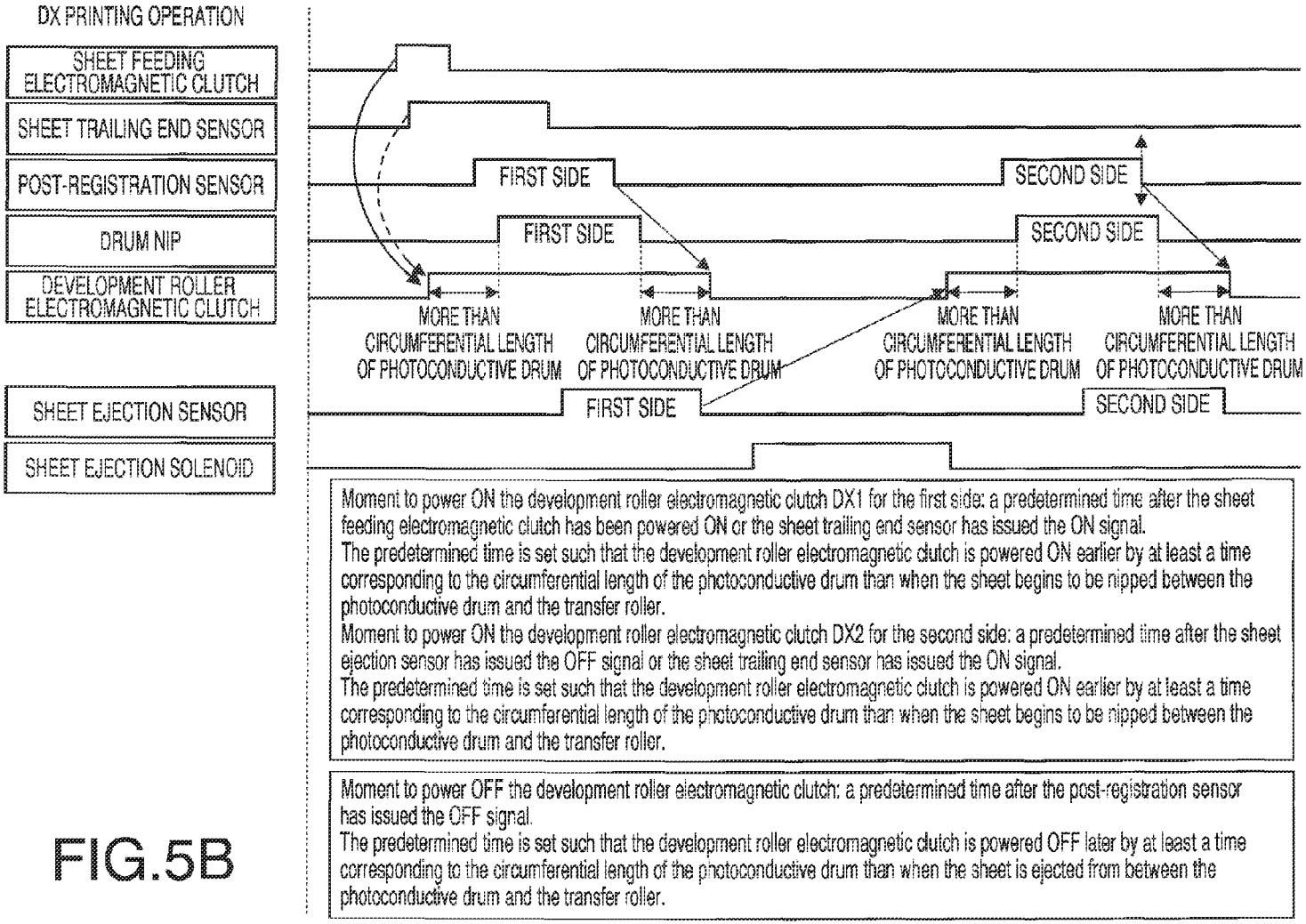

FIGS. 5A and 5B are timing charts illustrating operations of the development roller electromagnetic clutch in the first embodiment according to one or more aspects of the present invention.

Figure 6:
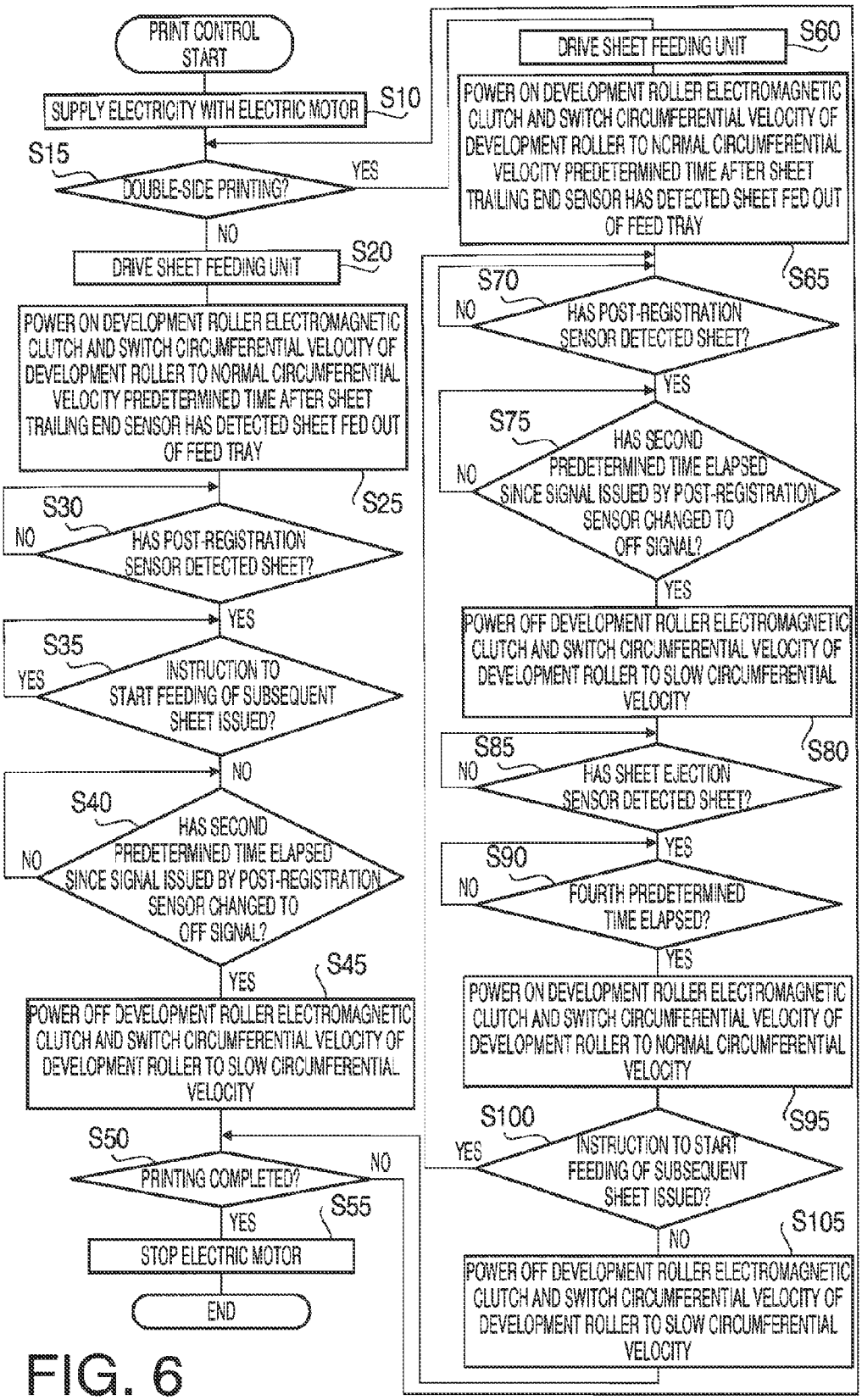

FIG. 6 is a flowchart for illustrating the operations of the development roller electromagnetic clutch in the first embodiment according to one or more aspects of the present invention.

Figure 7:
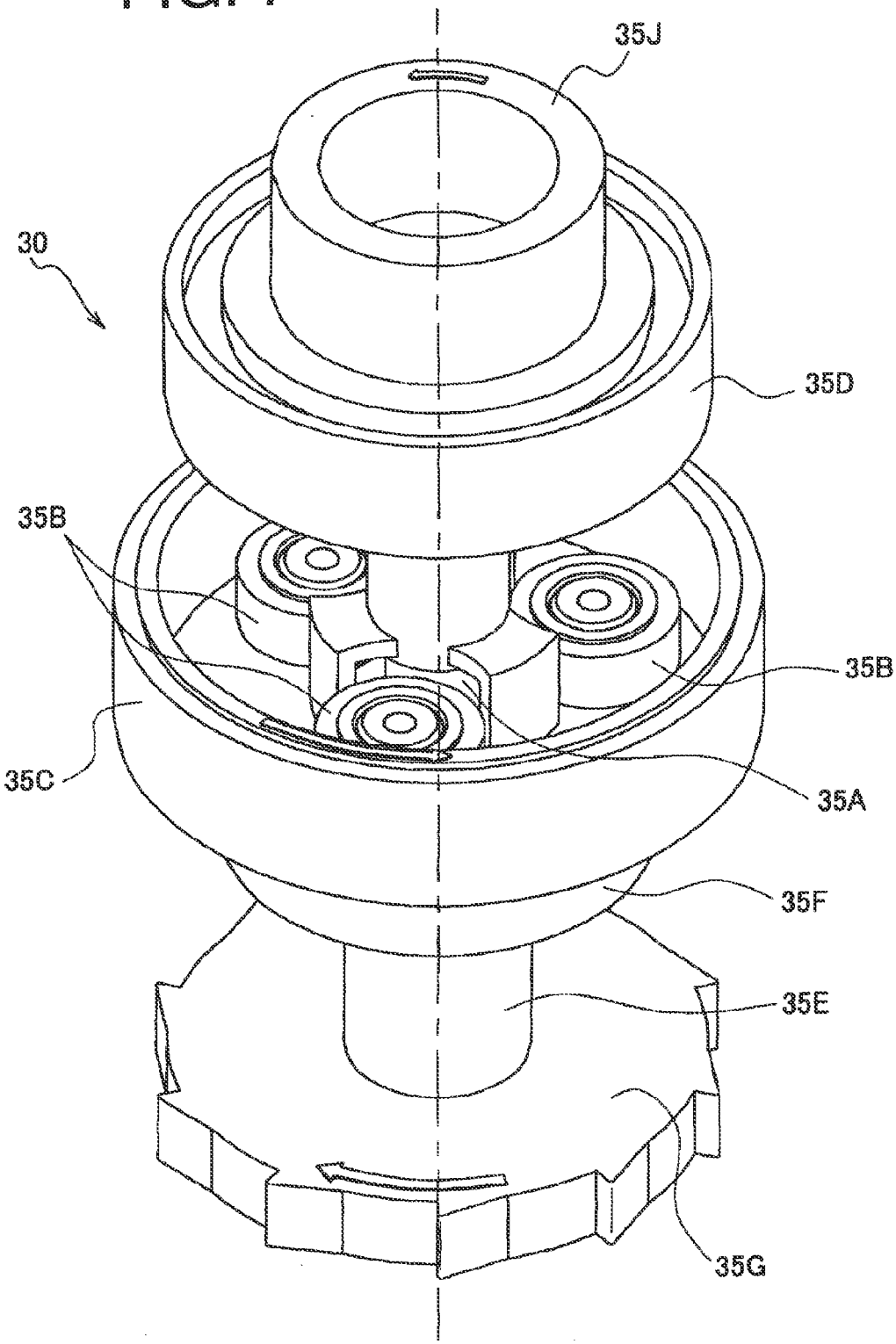

FIG. 7 is an exploded perspective view of a circumferential velocity switching mechanism in a second embodiment according to one or more aspects of the present invention.

Figure 8:
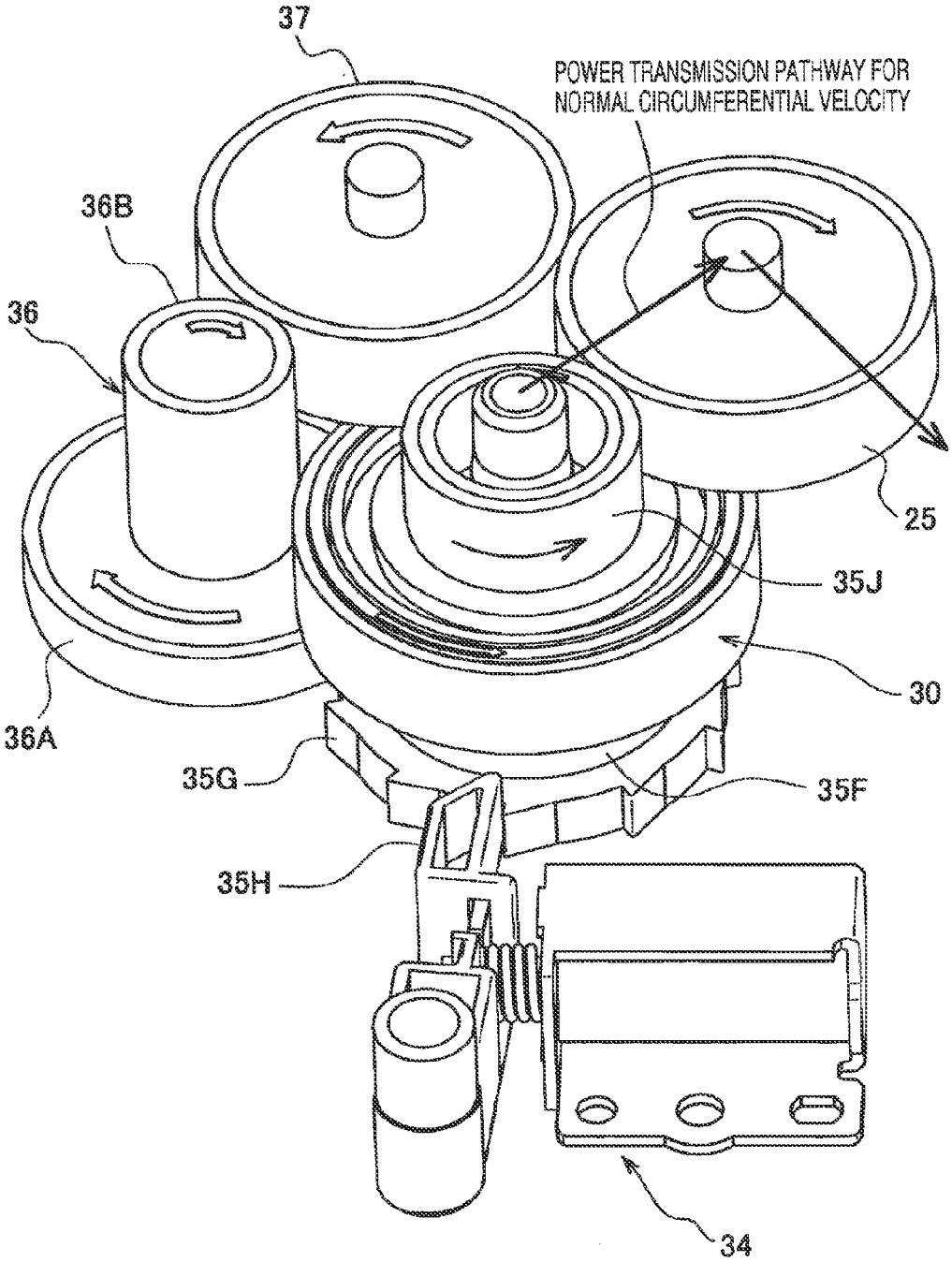
Figure 9:
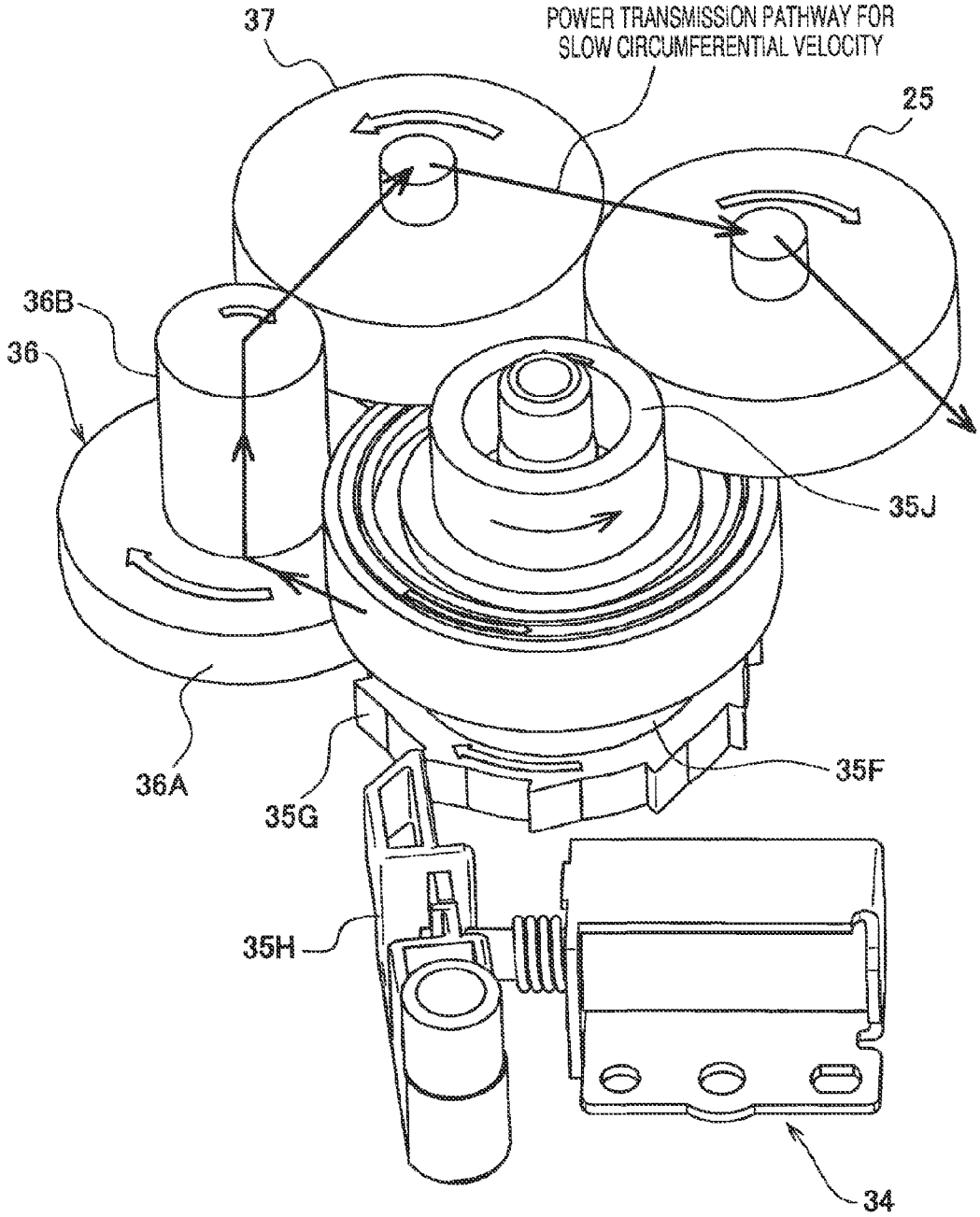

FIGS. 8 and 9 are perspective views of a gear mechanism in the second embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described with reference to the accompanying drawings. It is noted that, in the following embodiments, aspects of the present invention are applied to one or more image forming apparatuses using one-component development agent without any carrier contained therein.

First Embodiment

1. General Configuration of Image Forming Apparatus

Figure 1:
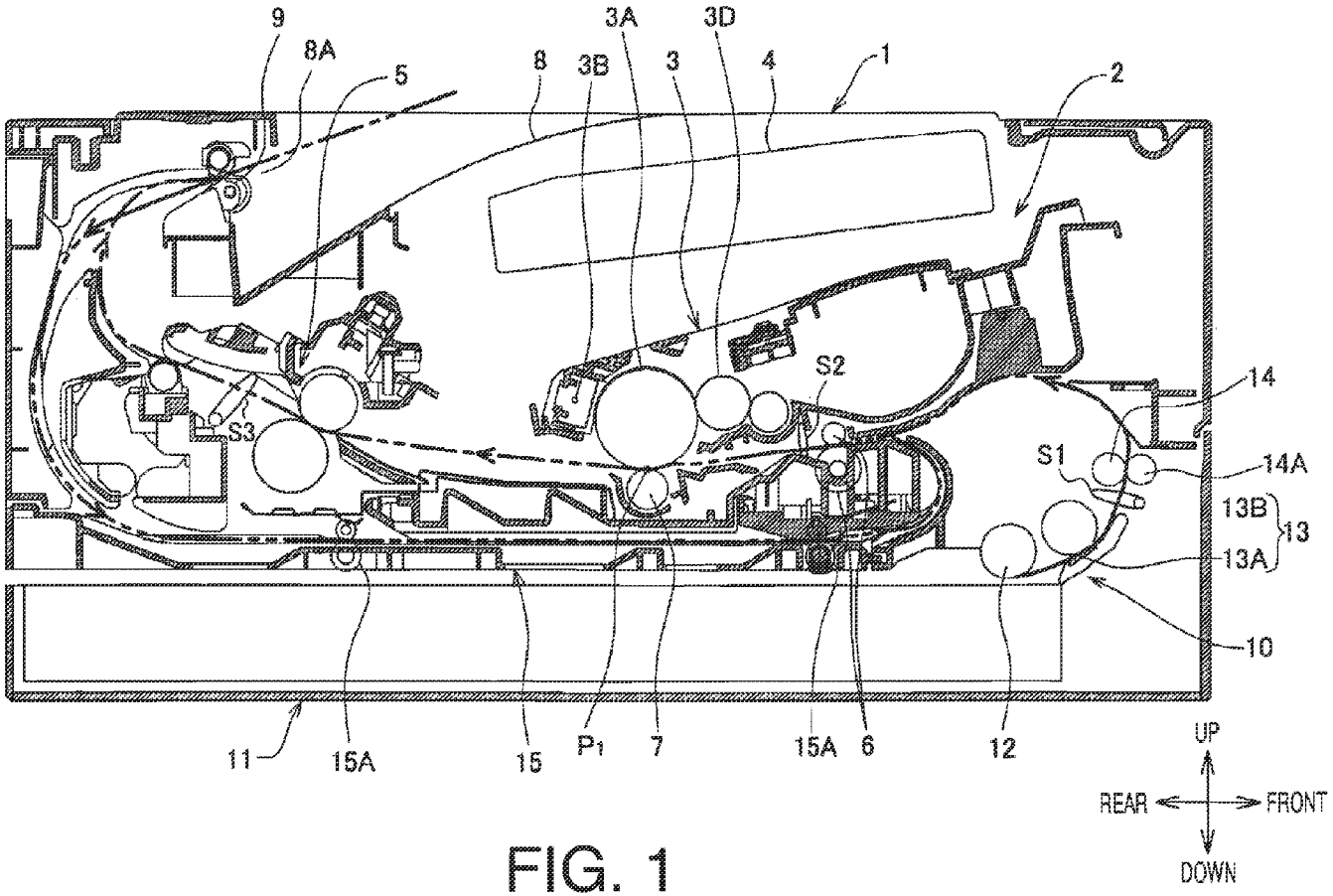
FIG. 1 is a cross-sectional side view of an image forming apparatus in a first embodiment according to one or more aspects of the present invention.

As shown in FIG. 1, an image forming apparatus 1 includes an image forming unit 2 and a sheet feeding unit 10. The image forming unit 2 is configured to form (print) an image on a sheet such as a paper and a transparency. The sheet feeding unit 10 is configured to feed a sheet to the image forming unit 2.

The image forming unit 2 is an electrophotographic image forming unit that includes a process cartridge 3, an exposure unit 4, and a fixing unit 5. The process cartridge 3 contains a photoconductive drum 3A configured to carry development agent thereon, an electrification device 3B configured to charge the photoconductive drum 3A, and a development roller 3D configured to supply development agent onto the photoconductive drum 3A while rotating substantially in constant contact with the photoconductive drum 3A.

The exposure unit 4 is configured to expose a charged outer circumferential surface of the photoconductive drum 3A and form an electrostatic latent image on the photoconductive drum 3A. When the development agent is supplied from the development roller 3D to the photoconductive drum 3A with the electrostatic latent image formed thereon, a developer image is formed and carried on the photoconductive drum 3A.

Meanwhile, the sheet fed to the image forming unit 2 by the sheet feeding unit 10 is conveyed to a pair of registration rollers 6. The registration rollers 6 once stops the feeding of the sheet to perform skew correction for the sheet, and then feeds the sheet to the photoconductive drum 3A at a predetermined moment. Thus, it is possible to adjust image transfer timing for transferring the developer image onto the sheet.

A transfer roller 7 is disposed in a position to face the photoconductive drum 3A across the sheet being conveyed. The transfer roller 7 is configured to transfer the developer image carried on the photoconductive drum 3A. The sheet with the developer image completely transferred thereon is, after heated by the fixing unit 5, conveyed upward along a feeding direction and ejected onto a catch tray 8 formed on an upper face side of the image forming apparatus 1. It is noted that, when heated by the fixing unit 5, the transferred developer image is made melt and fixedly adhere onto the sheet.

Further, the sheet feeding unit 10 includes a feed tray 11 configured to accommodate a stack of sheets to be fed to the image forming unit 2, a pickup roller 12 configured to contact a top one of the sheets stacked on the feed tray 11 and feed sheets (including the top sheet) to the image forming unit 2, a separation mechanism that includes a separation pad 13A and a separation roller 13B, and a feed roller 14 configured to provide a feeding force to a sheet.

The separation mechanism 13 is configured to separate and convey the sheets fed by the pickup roller 1, to the image forming unit 2 on a sheet-by-sheet basis, while providing a feed resistance to a separation-pad-side one of the sheets 2 by the separation pad 13A and providing a feeding force to a separation-roller-side one of the sheets by the separation roller 13B. It is noted that the separation-pad-side sheet denotes a sheet contacting the separation pad 13A. Further, the separation-roller-side sheet denotes a sheet contacting the separation roller 13B.

Further, a re-feeding unit 15 is a double-side printing unit configured to feed the sheet ejected from the fixing unit 5 (i.e., the sheet with an image formed on a first side thereof) to an inlet side of the registration rollers 6 to form an image on a second side (the other side) of the sheet. The re-feeding unit 15 includes feed rollers 15A configured to provide a feeding force to the sheet fed by the re-feeding unit 15.

At an ejection port 8A through which the sheet with the image(s) completely formed thereon is ejected, an ejection roller 9 is disposed. The ejection roller 9 is reversely rotated in order to feed the sheet to the re-feeding unit 15.

2. Driving System for Driving Photoconductive Drum and Development Roller 2.1. General Overview In the first embodiment, rollers such as the photoconductive drum 3A and the development roller 3D that directly relate to image formation and rollers such as the feed roller 14 and the registration rollers 6 that relate to sheet feeding (containing re-feeding by the re-feeding unit 15) are rotated by a driving force from a single electric motor Mo (see FIG. 2) via a gear mechanism including a plurality of gears.

Timing control to start and stop rotation of the pickup roller 12 and the registration rollers 6 is carried out by adjusting ON/OFF timing to supply electricity to electromagnetic clutches Mc1 and Mc2 (see FIG. 2), which is configured to permit and interrupt transmission of the driving force on transmission pathways from the electromagnetic motor Mo to the pickup roller 12 and the registration rollers 6.

Transmission pathways for transmitting the driving force from the electromagnetic motor Mo to the ejection roller 9 include a first transmission pathway for normal rotation (i.e., rotation in a normal direction to eject the sheet onto the catch tray 8) and a second transmission pathway for reverse rotation (i.e., rotation in a reverse direction to feed the sheet to the re-feeding unit 15). Switching between the two transmission pathways is controlled, for instance, by a sheet ejection electromagnetic solenoid Ms1 (see FIG. 2).

Further, a gear mechanism 20 for transmitting the driving force from the electric motor Mo to the development roller 3D includes a circumferential velocity switching mechanism 30. As shown in FIGS. 3A and 3B, the circumferential velocity switching mechanism 30 is configured to switch between a state to rotate the development roller 3D at a first circumferential velocity (hereinafter referred to as a normal circumferential velocity) and a state to rotate the development roller 3D at a second circumferential velocity (hereinafter referred to as a slow circumferential velocity).

A pathway, indicated by a solid line in FIG. 3A, shows a transmission pathway for driving the development roller 3D at the normal circumferential velocity. A pathway, indicated by a chain double-dashed line in FIG. 3A, shows a transmission pathway for driving the development roller 3D at the slow circumferential velocity.

In the first embodiment, the normal circumferential velocity is higher than a circumferential velocity of the photoconductive drum 3A. In addition, the slow circumferential velocity is lower than the circumferential velocity of the photoconductive drum 3A. It is noted that the photoconductive drum 3A is configured to rotate at a constant circumferential velocity regardless of an operational state of the circumferential velocity switching mechanism 30.

2.2. Detailed Configuration of Gear Mechanism and Circumferential Velocity Switching Mechanism As shown in FIG. 3A, the gear mechanism 20 includes gears 21 to 24 for lowering the driving force from the electric motor Mo and transmitting the lowered driving force to the circumferential velocity switching mechanism 30, and a development roller driving gear 25 for transmitting the driving force from the circumferential velocity switching mechanism 30 to the development roller 3D.

The driving gear 21 is configured to receive the driving force from the electric motor Mo and transmit the driving force to the power transfer gear 22. As shown in FIG. 3B, the power transfer gear 22 is a three-step gear that includes three gears 22A, 22B, and 22C arranged coaxially in an integrated manner. The power transfer gear 22 is configured to transfer the driving force from the driving gear 21 to both the transmission pathway for driving the development roller 3D at the normal circumferential velocity and the transmission pathway for driving the development roller 3D at the slow circumferential velocity.

Specifically, the gear 22A of the power transfer gear 22 is a driven gear that engages with the driving gear 21. The gear 22B is a driven gear configured to transmit the driving force to a first input gear 30A of the circumferential velocity switching mechanism 30. The gear 22C is a driven gear configured to transmit the driving force to a second input gear 30B of the circumferential velocity switching mechanism 30.

The gear 22B of the power transfer gear 22 transmits the driving force to the first input gear 30A via a first intermediate gear 23. The gear 22C of the power transfer gear 22 transmits the driving force to the second input gear 30B via a second intermediate gear 24.

Therefore, as the gears 21 to 24 are rotated in conjunction with rotation of the electric motor Mo, the first input gear 30A and the second input gear 30B of the circumferential velocity switching mechanism 30 is rotated and stopped in conjunction with rotation and stop of the electric motor Mo. Namely, the first input gear 30A and the second input gear 30B are rotated and stopped in conjunction with rotation and stop of the electric motor Mo, regardless of the state of the circumferential velocity switching mechanism 30 (a development roller electromagnetic clutch 32).

As shown in FIG. 4A, the circumferential velocity switching mechanism 30 includes the first input gear 30A, the second input gear 30B, an output gear 30C, a one-way clutch 31, and the development roller electromagnetic clutch 32.

The first input gear 30A is a first input section for rotating the development roller 3D at the normal circumferential velocity. The second input gear 30B is a second input section for rotating the development roller 3D at the normal circumferential velocity. The output gear 30C is an output section configured to be rotated by the driving force from the first input gear 30A or the second input gear 30B and output the driving force to the development roller 3D while engaging with the development roller driving gear 25

The output gear 30C is integrated with a rotational shaft 33. The rotational shaft 33 extends in an axis line direction, passes through the first input gear 30A and the second input gear 30B, and is joined with the second input gear 30B via the one-way clutch 31.

Therefore, on the transmission pathway from the second input gear 30B to the output gear 30C, owing to the one-way clutch 31, a rotational force is transmitted from the second input gear 30B to the output gear 30C through the rotational shaft 33 while transmission of a rotational force from the output gear 30C (the rotational shaft 33) to the second input gear 30B is interrupted.

Further, a rotor coil 32A of the development roller electromagnetic clutch 32 engages with the rotational shaft 33 via a spline (e.g., see JIS D 2001) or a serration (e.g., see JIS B 1602). Hence, the rotor coil 32A is allowed to move in an axial direction while rotating integrally with the rotational shaft 33.

Meanwhile, an armature 32B, which forms a stator iron core of the development roller electromagnetic clutch 32, is integrated with the first input gear 30A. The first input gear 30A is rotatably attached to the rotational shaft 33 via a bearing (not shown).

Accordingly, when supplied with electricity, the rotor coil 32A is attracted by the armature 32B by the action of an electromagnetic attractive force such that the rotor coil 32A is integrated with the armature 32B. Thus, the driving force is transmitted from the first input gear 30A to the rotational shaft 33, and the transmission pathway from the first input gear 30A to the output gear 30C is established (see FIG. 4A).

At this time, the rotational shaft 33 receives the driving force (hereinafter referred to as a normal driving force) from the first input gear 30A and the driving force (hereinafter referred to as a slow driving force) from the second input gear 30B. Since the slow driving force is transmitted at a lower revolution than the normal driving force, the slow driving force acts to rotate the rotational shaft 33 in a rotational direction opposite to that of the normal driving force when viewed from the rotational shaft 33. Thus, transmission of the slow driving force is blocked by the one-way clutch.

Therefore, when the rotor coil 32A is supplied with electricity (hereinafter referred to as an ON state), only the normal driving force is transmitted to the rotational shaft 33, and the development roller 3D rotates at the normal circumferential velocity.

Meanwhile, when the supply of electricity to the rotor coil 32A is interrupted (hereinafter referred to as an OFF state), the electromagnetic attractive force disappears, and the transmission of the driving force from the first input gear 30A to the output gear 30C (the rotational shaft 33) is interrupted (see FIG. 4B). Therefore, only the slow driving force is transmitted to the rotational shaft 33 such that the development roller 3D rotates at the slow circumferential velocity.

3. Control System for Development Roller Electromagnetic Clutch

Figure 2:
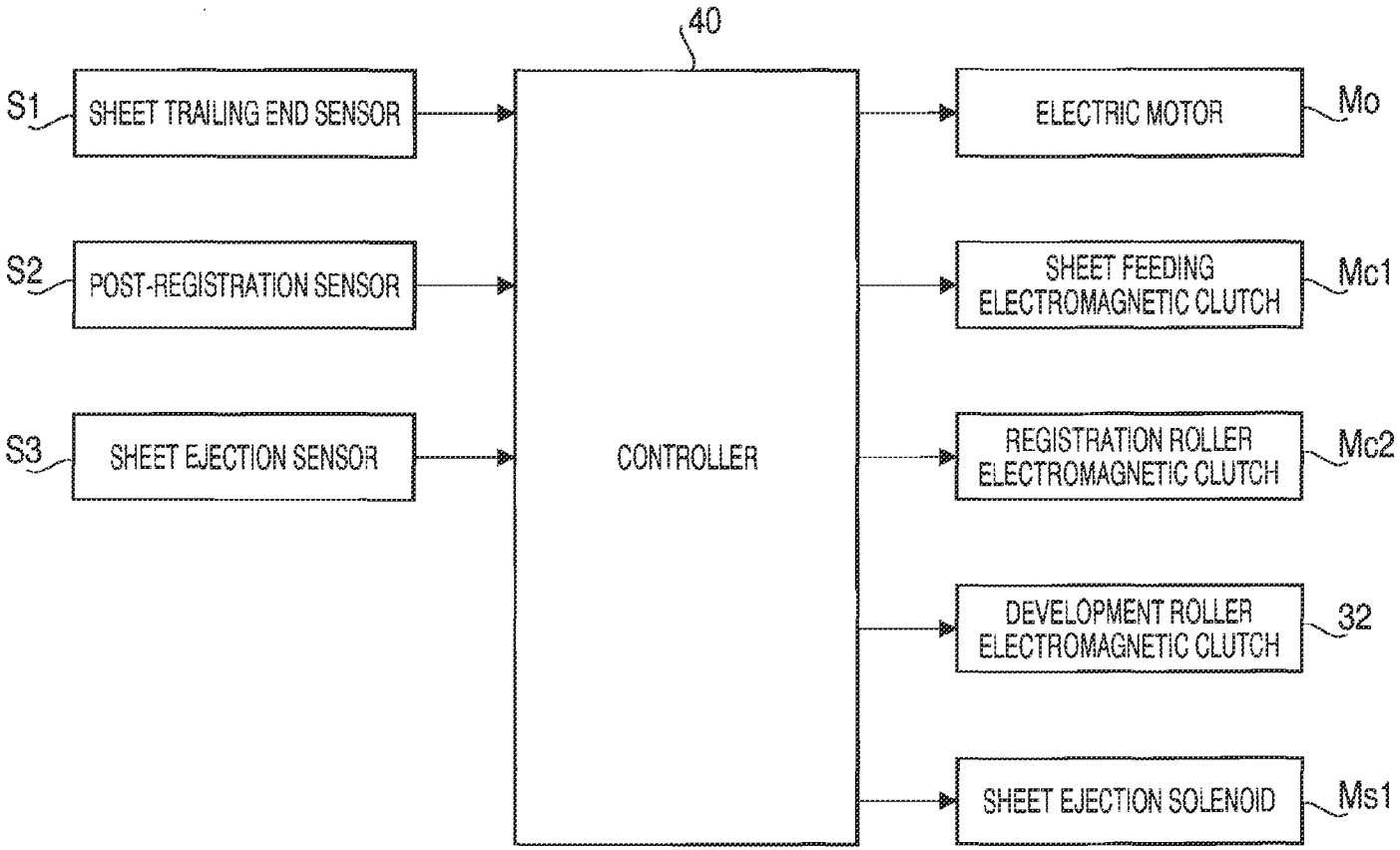
FIG. 2 is a block diagram showing a control system of the image forming apparatus in the first embodiment according to one or more aspects of the present invention.

As shown in FIG. 2, operations of the electric motor Mo, the electromagnetic clutches Mc1 and Mc2, the development roller electromagnetic clutch 32, and the electromagnetic solenoid Ms1 are controlled by a controller 40. The controller 40 is a known microcomputer that includes a CPU, a RAM, and a ROM. It is noted that a non-volatile storage device such as a ROM (hereinafter, simply referred to as a ROM) stores programs for performing below-mentioned control.

In addition, the controller 40 receives signals from a sheet trailing end sensor S1 configured to detect whether a sheet is fed out of the feed tray 11, a post-registration sensor S2 configured to detect whether a sheet is fed out of the registration rollers 6, and a sheet ejection sensor S3 configured to detect whether a sheet is fed out of the fixing unit 5. The controller 40 controls the operation of the development roller electromagnetic clutch 32 in accordance with a previously stored program based on moments when the sensors S1 to S3 issue signals.

Each of the sheet trailing end sensor S1, the post-registration sensor S2, and the sheet ejection sensor S3 is configured to issue an ON signal when there is a sheet in a position where the sensor is provided and to issue an OFF signal there is no sheet in the position where the sensor is provided.

4. Control of Circumferential Velocity of Development Roller (Control of Development Roller Electromagnetic Clutch)

4.1. General Overview of Control Operations (See FIGS. 5A and 5B)

The controller 40 begins to supply electricity to the electric motor Mo in the situation where the development roller electromagnetic clutch 32 is powered OFF. The controller 40 switches the circumferential velocity of the development roller 3D from the slow circumferential velocity to the normal circumferential velocity no later than when development of the photoconductive drum 3A is started. Further, the controller 40 switches the circumferential velocity of the development roller 3D from the normal circumferential velocity to the slow circumferential velocity when or after the development of the photoconductive drum 3A has been completed.

In other words, the controller 40 controls the development roller 3D to rotate at the slow circumferential velocity after the sheet feeding unit 10 performs sheet feeding, namely, when the pickup roller 12 begins to be rotated in response to engagement of the sheet feeding electromagnetic clutch Mc1. Thereafter, the controller 40 powers ON the development roller electromagnetic clutch 32 and switches the circumferential velocity of the development roller 3D to the normal circumferential velocity no later than when the development of the photoconductive drum 3A is started. Moreover, the controller 40 switches the circumferential velocity of the development roller 3D from the normal circumferential velocity to the slow circumferential velocity when or after the development of the photoconductive drum 3A has been completed.

Here, the aforementioned "no later than when the development of the photoconductive drum 3A is started" includes (a) "when a predetermined time has elapsed since the pickup roller 12 began to be rotated in response to engagement of the sheet feeding electromagnetic clutch Mc1" and (b) "when a predetermined time has elapsed since the sheet trailing end sensor S1 issued the ON signal (the signal issued by the sheet trailing end sensor S1 was switched from the OFF signal to the ON signal)."

Further, in the first embodiment, each of the aforementioned two "predetermined times" (hereinafter referred to as a first predetermined time) is determined as a time required for a leading end of the sheet fed toward the photoconductive drum 3A in a feeding direction to reach a position short of a nipping point P1 between the photoconductive drum 3A and the transfer roller 7 (see FIG. 1) by a circumferential length of the photoconductive drum 3A.

Namely, in the first embodiment, a moment to switch the circumferential velocity of the development roller 3D from the slow circumferential velocity to the normal circumferential velocity is determined based on a moment when an instruction to start sheet feeding is issued to the sheet feeding unit 10.

Further, the aforementioned "when or after the development of the photoconductive drum 3A has been completed" means "when or after a trailing end of the sheet in the feeding direction has passed through the nipping point P1". More specifically, in the first embodiment, it means "when or after a predetermined time has elapsed since the signal issued by the post-registration sensor S2 changed from the ON signal to the OFF signal.

Moreover, in the first embodiment, the "predetermined time (hereinafter referred to as a second predetermined time)" is determined as a time required for the trailing end of the sheet in the feeding direction to reach a position ahead of the nipping point P1 by the circumferential length of the photoconductive drum 3A.

Namely, in the first embodiment, a moment to switch the circumferential velocity of the development roller 3D from the normal circumferential velocity to the slow circumferential velocity is determined based on a moment when the post-registration sensor S2 detects the existence of a sheet.

However, when two or more sheets are continuously printed, namely, when an instruction to start feeding of a second sheet has been issued in response to re-engagement of the sheet feeding electromagnetic clutch Mc1 before a lapse of a predetermined time (hereinafter referred to as a third predetermined time) since the pickup roller 12 began to rotate and a first sheet was fed in response to engagement of the sheet feeding electromagnetic clutch Mc1, the controller 40 maintains the normal circumferential velocity without switching the circumferential velocity of the development roller 3D from the normal circumferential velocity to the slow circumferential velocity even when the second predetermined time for the first sheet has elapsed (see a timing chart indicated by a dashed line in an SX printing operation shown in FIG. 5A).

Further, when image formation on the second side of the sheet (hereinafter referred to as double-side printing (a DX printing operation)) is performed following the complete image formation on the first side of the sheet, the sheet is fed from the re-feeding unit 15 to the photoconductive drum 3A, and the circumferential velocity of the development roller 3D is switched from the slow circumferential velocity to the normal circumferential velocity "no later than when the development of the photoconductive drum 3A is started."

In this case, in the first embodiment, the aforementioned "no later than when the development of the photoconductive drum 3A is started" includes (a) "when a predetermined time has elapsed since the rotation direction of the ejection roller 9 was switched from a reverse direction to a normal direction (the state of the sheet ejection electromagnetic solenoid Ms1 is switched from an ON state to an OFF state" and (b) "when a predetermined time has elapsed since the sheet ejection sensor S3 issued the OFF signal (the signal issued by the sheet ejection sensor S3 was switched from the ON signal to the OFF signal)."

In the first embodiment, each of the aforementioned two "predetermined times" (hereinafter referred to as a fourth predetermined time) is determined as a time required for the leading end of the sheet fed from the re-feeding unit 15 to the photoconductive drum 3A in the feeding direction to reach the position short of the nipping point P1 by the circumferential length of the photoconductive drum 3A, in the same manner as the first predetermined time.

4.2. Detailed Control Operations (See FIG. 6)

FIG. 6 is a flowchart exemplifying a specific control flow of the aforementioned control operations. A program for executing the control shown in FIG. 6 is stored on the ROM.

When a device such as a personal computer issues a printing instruction to the image forming apparatus 1, the controller 40 first begins to supply electricity to the electric motor Mo in the situation where the development roller electromagnetic clutch 32 is powered OFF (S10). Then, the controller 40 determines whether the printing instruction is a double-side printing instruction (S15).

When determining that the printing instruction is not a double-side printing instruction but a single-side printing instruction (S15: No), the controller 40 engages the sheet feeding electromagnetic clutch Mc1 and controls the sheet feeding unit 10 to perform sheet feeding (S20).

Then, when the first predetermined time has elapsed since the sheet trailing end sensor S1 issued the ON signal, the controller 40 powers ON the development roller electromagnetic clutch 32 and switches the circumferential velocity of the development roller 3D from the slow circumferential velocity to the normal circumferential velocity (S25).

After that, the controller 40 determines whether the post-registration sensor S2 has detected the existence of a sheet, namely, whether the signal issued by the post-registration sensor S2 has changed from the OFF signal to the ON signal (S30). When determining that the post-registration sensor S2 has not detected the existence of a sheet (S30: No), the controller 40 again executes S30.

Meanwhile, when determining that the post-registration sensor S2 has detected the existence of a sheet (S30: Yes), the controller 40 determines whether an instruction to start feeding of a subsequent sheet has been issued (whether the sheet trailing end sensor S1 has detected a subsequent sheet fed out of the feed tray 11) (S35). When determining that an instruction to start feeding of a subsequent sheet has been issued (S35: Yes), the controller 40 again executes S35 and maintains the normal circumferential velocity of the development roller 3D.

The determination in S35 is made when the post-registration sensor S2 issues the ON signal. Therefore, the determination is made within the third predetermined time since the sheet feeding electromagnetic clutch Mc1 has been powered ON for the first sheet.

Meanwhile, when determining that an instruction to start feeding of a subsequent sheet has not been issued (S35: No), the controller 40 determines whether it is at or after the time when the development of the photoconductive drum 3A has been completed, namely, whether the second predetermined time has elapsed since the signal issued by the post-registration sensor S2 changed from the ON signal to the OFF signal (S40).

When determining that it is not at or after the time when the development of the photoconductive drum 3A has been completed (S40: No), the controller 40 again executes S40. Meanwhile, when determining that it is at or after the time when the development of the photoconductive drum 3A has been completed (S40: Yes), the controller 40 powers OFF the development roller electromagnetic clutch 32 and switches the circumferential velocity of the development roller 3D from the normal circumferential velocity to the slow circumferential velocity (S45).

Next, the controller 40 determines whether the image formation has completely been performed for a reserved number of sheets (S50). When determining that the image formation has completely been performed for a reserved number of sheets (S50: Yes), the controller 40 stops the electric motor Mo (S55). Meanwhile, when determining that the image formation has not completely been performed for a reserved number of sheets (S50: No), the controller 40 goes back to S15.

Further, when determining that the printing instruction is a double-side printing instruction (S15: Yes), the controller 40 engages the sheet feeding electromagnetic clutch Mc1 and controls the sheet feeding unit 10 to perform sheet feeding (S60). Thereafter, when the first predetermined time has elapsed since the sheet trailing end sensor S1 issued the ON signal, the controller 40 powers ON the development roller electromagnetic clutch 32 and switches the circumferential velocity of the development roller 3D from the slow circumferential velocity to the normal circumferential velocity (S65).

Thereafter, the controller 40 determines whether the post-registration sensor S2 has detected the existence of a sheet (S70). When determining that the post-registration sensor S2 has not detected the existence of a sheet (S70: No), the controller 40 again executes S70. Meanwhile, when determining that the post-registration sensor S2 has detected the existence of a sheet (S70: Yes), the controller 40 determines whether it is at or after the time when the development of the photoconductive drum 3A has been completed (whether the second predetermined time has elapsed since the signal issued by the post-registration sensor S2 changed from the ON signal to the OFF signal) (S75).

When determining that it is not at or after the time when the development of the photoconductive drum 3A has been completed (S75: No), the controller 40 again executes S75. Meanwhile, when determining that it is at or after the time when the development of the photoconductive drum 3A has been completed (S75: Yes), the controller 40 powers OFF the development roller electromagnetic clutch 32 and switches the circumferential velocity of the development roller 3D from the normal circumferential velocity to the slow circumferential velocity (S80).

Subsequently, the controller 40 determines whether the sheet ejection sensor S3 has detected the existence of a sheet, namely, whether the signal issued by the sheet ejection sensor S3 is switched from the OFF signal to the ON signal (S85). When determining that the sheet ejection sensor S3 has not detected the existence of a sheet (S85: No), the controller 40 again executes S85.

Meanwhile, when determining that the sheet ejection sensor S3 has detected the existence of a sheet (S85: Yes), the controller 40 determines whether the fourth predetermined time has elapsed since the sheet ejection sensor S3 issued the OFF signal (S90). When determining that the fourth predetermined time has not elapsed since the sheet ejection sensor S3 issued the OFF signal (S90: No), the controller 40 again executes S90.

Meanwhile, when determining that the fourth predetermined time has elapsed since the sheet ejection sensor S3 issued the OFF signal (S90: Yes), the controller 40 powers ON the development roller electromagnetic clutch 32 and switches the circumferential velocity of the development roller 3D from the slow circumferential velocity to the normal circumferential velocity (S95). Thereafter, the controller 40 determines whether an instruction to start feeding of a subsequent sheet has been issued (S100).

When determining that an instruction to start feeding of a subsequent sheet has been issued (S100: Yes), the controller 40 goes back to S70 while maintaining the normal circumferential velocity of the development roller 3D. Meanwhile, when determining that an instruction to start feeding of a subsequent sheet has not been issued (S100: No), the controller 40 powers OFF the development roller electromagnetic clutch 32 and switches the circumferential velocity of the development roller 3D from the normal circumferential velocity to the slow circumferential velocity (S105). Then, the controller 40 goes to S50.

5. Features of Image Forming Apparatus in First Embodiment

In the first embodiment, the moment to switch the circumferential velocity of the development roller 3D from the slow circumferential velocity to the normal circumferential velocity is determined based on the moment when the instruction to start sheet feeding is issued to the sheet feeding unit 10. Further, the moment to switch the circumferential velocity of the development roller 3D from the normal circumferential velocity to the slow circumferential velocity is determined based on the moment when the post-registration sensor S2 detects the existence of a sheet.

Thereby, in the first embodiment, it is possible to rotate the development roller 3D at the slow circumferential velocity during the times that do not directly relate to the image formation. Thus, it is possible to effectively prevent deterioration of the development agent.

Further, in the first embodiment, the circumferential velocity of the development roller 3D is switched from the slow circumferential velocity to the normal circumferential velocity when the first predetermined time has elapsed since the instruction to start sheet feeding was issued to the sheet feeding unit 10.

Thereby, in the first embodiment, it is possible to switch the circumferential velocity of the development roller 3D from the slow circumferential velocity to the normal circumferential velocity no later than when the development of the photoconductive drum 3A is started. Thus, it is possible to effectively prevent deterioration of the development agent while maintaining preferred image formation.

Further, in the first embodiment, when another instruction to start sheet feeding has been issued before a lapse of the third predetermined time since the previous instruction to start sheet feeding was issued, the normal circumferential velocity of the development roller 3D is maintained.

Thereby, in the first embodiment, when two or more sheets are continuously fed, it is possible to perform image formation without lowering the image forming speed. Moreover, in the first embodiment, the image forming apparatus 1 includes the re-feeding unit 15 configured to feed the sheet ejected from the photoconductive drum 3A to the inlet side of the registration rollers 6 and the sheet ejection sensor S3 configured to detect the existence of a sheet to be fed by the re-feeding unit 15. Further, the moment to switch the circumferential velocity of the development roller 3D from the slow circumferential velocity to the normal circumferential velocity is determined based on the moment when the sheet ejection sensor S3 detects the existence of a sheet.

Thereby, in the first embodiment, during the time that does not directly relate to the image formation on the second side of the sheet after the image formation on the first side of the sheet has been completed, it is possible to rotate the development roller 3D at the slow circumferential velocity. Thus, it is possible to effectively prevent deterioration of the development agent.

In the first embodiment, the image forming apparatus 1 is configured to switch the circumferential velocity of the development roller 3D in order to prevent deterioration of the development agent. However, the image forming apparatus 1 may be configured to put the development roller 3D into contact or non-contact with the photoconductive drum 7A at the same moments as those for switching the circumferential velocity of the development roller 3D in order to prevent deterioration of the development agent.

However, the above solution needs a mechanism for moving (displacing) the development roller 3D. Thus, it might lead to a complicated configuration and an increased manufacturing cost of the image forming apparatus 1. On the contrary, in the first embodiment, the development roller 3D is always in contact with the photoconductive drum 3A. Namely, in the first embodiment, it is possible to effectively prevent deterioration of the development agent without moving the development roller 3D relative to the photoconductive drum 3A. In other words, it is possible to effectively prevent deterioration of the development agent by a simpler configuration than that of an image forming apparatus having a mechanism for moving the development roller 3D.

Further, in the first embodiment, no later than when the development of the photoconductive drum 3A is started, the circumferential velocity of the development roller 3D is switched from the slow circumferential velocity to the normal circumferential velocity. Further, when or after the development of the photoconductive drum 3A has been completed, the circumferential velocity of the development roller 3D is switched from the normal circumferential velocity to the slow circumferential velocity.

Namely, in the first embodiment, it is possible to rotate the development roller 3D at the slow circumferential velocity during the times that do not directly relate to the image formation. Thus, it is possible to effectively prevent deterioration of the development agent.

In this case, the circumferential velocity of the development roller 3D is desired to be switched from the slow circumferential velocity to the normal circumferential velocity no later than when the development of the photoconductive drum 3A is started, after the sheet feeding unit 10 has performed sheet feeding.

Second Embodiment

In the aforementioned first embodiment, the circumferential velocity switching mechanism 30 includes the development roller electromagnetic clutch 32. In a second embodiment, as shown in FIG. 7, the circumferential velocity switching mechanism 30, which includes a planetary gear mechanism, is configured to switch the state of a sun gear 35A of the planetary gear mechanism by a solenoid 34 (see FIG. 8).

Namely, as shown in FIG. 7, the planetary gear mechanism (the circumferential velocity switching mechanism 30) includes the sun gear 35A, planet gears 35B configured to revolve around the sun gear 35A while engaging with the sun gear 35A and rotate about its own axis, a carrier gear 35C configured to support the plant gears 35B to revolve around the sun gear 35A while engaging with the sun gear 35A and rotate about its own axis and to be rotated by the driving force from the electric motor Mo, and an inner gear 35D that is rotatably provided to be coaxial with the sun gear 35A and configured to engage with the planets gears 35B.

In addition, a rotational shaft 35E, which is configured to rotate integrally with the sun gear 35A, includes a ratchet gear 35G configured to switch between a state to permit the rotation of the sun gear 35A (the rotational shaft 35E) and a state to regulate the rotation of the sun gear 35A (the rotational shaft 35E), in collaboration with a first output gear 35F and the solenoid 34.

When the solenoid 34 is supplied with electricity (an ON state), as shown in FIG. 8, the ratchet gear 35G is engaged with a locking claw 35H so as to regulate the rotation of the sun gear 35A. When the supply of electricity to the solenoid 34 is interrupted (an OFF state), as shown in FIG. 9, the ratchet gear 35G is disengaged from the locking claw 35H so as to allow the sun gear 35A to rotate.

Further, the inner gear 35D includes a second output gear 35J configured to rotate integrally with the inner gear 35D and engage with the development roller driving gear 25. The first output gear 35F engages with a large-diameter portion 36A of a two-step gear 36 that includes a one-way clutch. A small-diameter portion 36B of the two-step gear 36 engages with the development roller driving gear 25 via an intermediate gear 37.

When the carrier gear 35C is rotated by the driving force from the electric motor Mo in the state where the rotation of the sun gear 35A is regulated, the driving force is lowered to such a degree as to rotate the development roller 3D at the normal circumferential velocity, then transmitted to the inner gear 35D, and thereafter transmitted to the development roller driving gear 25.

At this time, the driving force from the development roller driving gear 25 is transmitted to the small-diameter portion 36B via the intermediate gear 37. Nonetheless, transmission of the driving force to the first output gear 35F is blocked by the one-way clutch included in the two-step gear 36.

When the carrier gear 35C is rotated by the driving force from the electric motor Mo in the state where the sun gear 35A is rotatable, the rotational direction of the second output gear 35J is opposite to the rotational direction of the first output gear 35F. The first output gear 35F is rotated in conjunction with rotation of the carrier gear 35C. As shown in FIG. 9, the driving force from the first output gear 35F is lowered to such a degree as to rotate the development roller 3D at the normal circumferential velocity, and transmitted to the development roller driving gear 25 via the two-step gear 36 and the intermediate gear 37.

The switching timing between the slow circumferential velocity and the normal circumferential velocity (i.e., the switching timing between the ON state and the OFF state of the solenoid 34) is controlled by the controller 40 in the same manner as exemplified in the first embodiment.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

Modifications

In the aforementioned embodiments, aspects of the present invention are applied to the monochrome image forming apparatus. However, aspects of the present invention may be applied to a color image forming apparatus of a direct tandem type or an intermediate transfer type.

The circumferential velocity switching mechanism 30 is not limited to the mechanism exemplified in the aforementioned embodiments, but may be a different type of circumferential velocity switching mechanism.

Further, in the aforementioned embodiments, the circumferential velocity of the development roller 3D is switched from the slow circumferential velocity to the normal circumferential velocity earlier by a time corresponding to the circumferential length of the photoconductive drum 3A than when the sheet is nipped between the photoconductive drum 3A and the transfer roller 7. Additionally, the circumferential velocity of the development roller 3D is switched from the normal circumferential velocity to the slow circumferential velocity when a time corresponding to the circumferential length of the photoconductive drum 3A has elapsed since the nipping of the sheet between the photoconductive drum 3A and the transfer roller 7 was completed. However, the timing control to switch the circumferential velocity of the development roller 3D may be performed in different manners.

What is claimed is:

1. An image forming apparatus configured to transfer development agent onto a sheet to electrophotographically form an image on the sheet, comprising:

a photoconductive drum configured to carry the development agent to be transferred onto the sheet;

an exposure unit configured to expose the photoconductive drum;

a development roller configured to supply the development agent to the photoconductive drum exposed by the exposure unit and develop the photoconductive drum;

a feed tray configured to accommodate the sheet to be fed to the photoconductive drum;

a sheet feeding unit configured to feed the sheet placed on the feed tray to the photoconductive drum;

a registration roller disposed on a feeding pathway from the feed tray to the photoconductive drum, the registration roller being configured to stop the feeding of the sheet by the sheet feeding unit once and adjust timing for transferring the development agent onto the sheet;

a first detector disposed downstream relative to the registration roller in a feeding direction, the first detector being configured to detect an existence of the sheet ejected from the registration roller;

a circumferential velocity switching mechanism configured to switch a circumferential velocity of the development roller between a first circumferential velocity and a second circumferential velocity lower than the first circumferential velocity; and a controller configured to:

determine a moment for switching the circumferential velocity of the development roller from the second circumferential velocity to the first circumferential velocity based on a moment when the controller issues, to the sheet feeding unit, an instruction to start feeding of the sheet; and determine a moment for switching the circumferential velocity of the development roller from the first circumferential velocity to the second circumferential velocity based on a moment when the first detector detects the existence of the sheet ejected from the registration roller.

2. The image forming apparatus according to claim 1, wherein the controller is configured to switch the circumferential velocity of the development roller from the second circumferential velocity to the first circumferential velocity when a predetermined time has elapsed since the issuance of the instruction to start feeding of the sheet to the sheet feeding unit.

3. The image forming apparatus according to claim 2, wherein the controller is configured to maintain the first circumferential velocity without switching the circumferential velocity of the development roller from the first circumferential velocity to the second circumferential velocity, when the controller issues to the sheet feeding unit a next instruction to start feeding of a subsequent sheet before a lapse of a prescribed time since the issuance of the instruction to start feeding of the sheet.

4. The image forming apparatus according to claim 1, further comprising:

a re-feeding unit configured to feed, to an inlet side of the registration roller, the sheet ejected from the photoconductive drum; and a second detector configured to detect the existence of the sheet to be fed by the re-feeding unit, wherein the controller is configured to determine a moment for switching the circumferential velocity of the development roller from the second circumferential velocity to the first circumferential velocity, based on a moment when the second detector detects the existence of the sheet to be fed by the re-feeding unit.

5. The image forming apparatus according to claim 1, wherein the circumferential velocity switching mechanism comprises:

a first input section configured to be driven to rotate the development roller at the first circumferential velocity;

a second input section configured to be driven to rotate the development roller at the second circumferential velocity;

an output section configured to be driven by a driving force from one of the first input section and the second input section;

a one-way clutch disposed on a driving force transmission pathway from the second input section and the output section, the one-way clutch being configured to transmit a driving force directed to the output section from the second input section and block a driving force directed to the second input section from the output section; and a clutch configured to permit and interrupt transmission of a driving force from the first input section to the output section, and wherein the controller is configured to control supply of electricity to the clutch to switch the circumferential velocity of the development roller.

6. The image forming apparatus according to claim 1, wherein the first circumferential velocity is higher than a circumferential velocity of the photoconductive drum, and wherein the second circumferential velocity is lower than the circumferential velocity of the photoconductive drum.

7. The image forming apparatus according to claim 1, wherein the photoconductive drum is substantially in constant contact with the development roller.

8. The image forming apparatus according to claim 1, wherein the development agent is a one-component development agent.

* * * * *